US009897940B2

(12) United States Patent
Iida et al.

(10) Patent No.: US 9,897,940 B2
(45) Date of Patent: Feb. 20, 2018

(54) DEVELOPING DEVICE AND CONVEYING SCREW FOR DEVELOPING AN ELECTROSTATIC LATENT IMAGE ON AN IMAGE BEARING MEMBER

(71) Applicant: CANON KABUSHIKI KAISHA, Tokyo (JP)

(72) Inventors: Takanori Iida, Noda (JP); Yusuke Ishida, Toride (JP); Yasushi Takeuchi, Moriya (JP); Toshiyuki Yamada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/250,482

(22) Filed: Aug. 29, 2016

(65) Prior Publication Data

US 2017/0060032 A1 Mar. 2, 2017

(30) Foreign Application Priority Data

Aug. 31, 2015 (JP) ..... 2015-170589

(51) Int. Cl.
*G03G 15/08* (2006.01)

(52) U.S. Cl.
CPC ..... *G03G 15/0893* (2013.01)

(58) Field of Classification Search
CPC ..... G03G 15/0891; G03G 15/0893
USPC ..... 399/254
See application file for complete search history.

(56) References Cited

U.S. PATENT DOCUMENTS

2009/0214266 A1* 8/2009 Kato ..... G03G 15/0893 399/254
2016/0370732 A1* 12/2016 Sasaki ..... G03G 15/0844

FOREIGN PATENT DOCUMENTS

| | | | |
|---|---|---|---|
| JP | 2002072686 | A | 3/2002 |
| JP | 2010256701 | A | 11/2010 |
| JP | 2012155144 | A | 8/2012 |
| JP | 2015011158 | A | 1/2015 |

OTHER PUBLICATIONS

Machine English Translation of JP 2012-155144 published Aug. 16, 2012.*

* cited by examiner

*Primary Examiner* — Billy Lactaoen
(74) *Attorney, Agent, or Firm* — Canon U.S.A., Inc. IP Division

(57) ABSTRACT

In the present invention, an image forming apparatus using a method of replacing a developer is configured such that an immobile area in which the heights of a discharge passage and a conveyance passage are changed on the upstream side of a returning screw is filled. This causes the immobile area of the developer to be unlikely to occur and accordingly suppresses formation of a toner stain image due to an aggregation toner, enabling stable image formation over a long period of time.

11 Claims, 9 Drawing Sheets

DEVELOPING DEVICE AND CONVEYING SCREW FOR DEVELOPING AN ELECTROSTATIC LATENT IMAGE ON AN IMAGE BEARING MEMBER

BACKGROUND OF THE INVENTION

Field of the Invention

The present invention relates to a developing device that develops an electrostatic latent image formed on an image bearing member with a developer.

Description of the Related Art

In a well-known electrophotographic image forming apparatus, a two-component developer whose main components are a toner and a carrier is used. With such a configuration using the two-component developer, the toner is consumed by image formation, and the developer is supplied to replenish the toner. Accordingly, the toner is gradually replaced by a new one, but the carrier is not substantially consumed. A continuation of the image formation consequently causes a charging performance to be gradually impaired. For this reason, the following method (method of automatically replacing the developer) for maintaining the charging performance of the carrier has been known: while the developer containing the carrier mixed in the toner is supplied, an excess of the developer is discharged from a developer container and the carrier that becomes old is thereby discharged.

In a known example of such a configuration, the excess of the developer is discharged from a discharge passage formed on the downstream, side of a conveyance passage through which the developer is conveyed in the developer container (Japanese Patent Laid-Open No. 2002-072686) in the case of the configuration disclosed in Japanese Patent Laid-Open No. 2002-072686, a returning screw that conveys the developer in the direction opposite to the direction in which a conveying screw conveys the developer in the conveyance passage is disposed on the downstream side of the conveying screw. The bottom surface of the discharge passage (discharge outlet) formed on the downstream side of the conveyance passage is located at a position higher than the bottom surface of the conveyance passage. The developer passing through the returning screw is discharged via the discharge passage. A discharging conveying screw that conveys the developer toward the outside is disposed in the discharge passage.

In an example of the method of automatically replacing the developer, as illustrated in FIG. 9, a disk portion 212*a* is disposed at an upstream end portion of a returning screw 212. The purpose is to suppress unstable discharging of the developer that is caused by the fact that the position of a blade of the upstream end portion of the returning screw is varied in accordance with a phase of the returning screw 212, and accordingly, the developer falls on the side of a discharge passage 213.

The above method of automatically replacing the developer has the following problem.

As illustrated in FIG. 9, the blade of the screw is not formed between the disk portion 212*a* on the upstream side of the returning screw 212 and a start position of the discharge passage 213 (area surrounded by a dotted line). The reason is as follows. There is a developer remaining in an immobile area between the disk portion 212*a* and the discharge passage 213. In the case where a blade portion is located between the disk portion 212*a* and the discharge passage 213, the developer remaining in this area is spattered. The spattered developer is discharged via the discharge passage. Consequently, the developer in the developer container is supplied between the disk portion 212*a* and the discharge passage 213, and discharging of the developer is repeated. Consequently, the amount of the developer in a developing device becomes lower than the intentional amount, resulting in a failure of an image.

The temperature of an end portion of a first conveying screw 204 may be increased by friction against a bearing 216 due to its rotation. Accordingly, the increase in the temperature of the end portion of the first conveying screw 204 may increase the temperature of the developer remaining in the immobile area illustrated within the frame of the dotted line in FIG. 9, and an aggregation toner may be generated. Vibration of the developing device (for example, when the body of an image forming apparatus is moved, or a unit of the image forming apparatus is replaced by a new one) causes the aggregation toner to enter a developer circulation path in the inside of the developing device. Consequently, the aggregation toner may be developed and a toner stain image may be formed.

SUMMARY OF THE INVENTION

The present invention provides a developing device using a method of replacing the developer that can suppress the generation of the aggregation toner in the immobile area around the returning screw, and a conveying screw.

A developing device according to an embodiment of the present invention includes a developer container that contains a developer, a conveying screw that conveys the developer and includes a rotating shaft rotatably disposed in the developer container, a spiral first blade portion that conveys the developer in a first direction of the rotating shaft, a spiral second blade portion that is formed on the rotating shaft at an end portion of the first blade portion and that conveys the developer in a direction opposite to the first direction, and a disk portion that is disposed on the rotating shaft at an end portion of the second blade portion distal from the first blade portion in an axial direction and that is disposed so as to protrude from the rotating shaft in a radial direction, a first conveyance passage in which the conveying screw is disposed and through which the developer is conveyed, a second conveyance passage that is formed on a downstream side of the disk portion in the first direction so as to be in communication with the first conveyance passage, that accommodates the rotating shaft in an inside thereof, and that is located at a position higher than a bottom surface of the first conveyance passage that the first blade portion faces, an outlet that is formed in the second conveyance passage and via which a toner is discharged, and a circular portion that is disposed on the rotating shaft at an end portion of the disk portion distal from the second blade portion in the axial direction and whose end portion distal from the disk portion has an outer diameter larger than an outer diameter of the rotating shaft and smaller than an outer diameter of the disk portion.

Further features of the present invention will become apparent from the following description of exemplary embodiments with reference to the attached drawings.

DESCRIPTION OF THE EMBODIMENTS

Embodiments of the present invention will hereinafter be described in detail with respect to the drawings.

First Embodiment

Image Forming Apparatus

Figure 1:
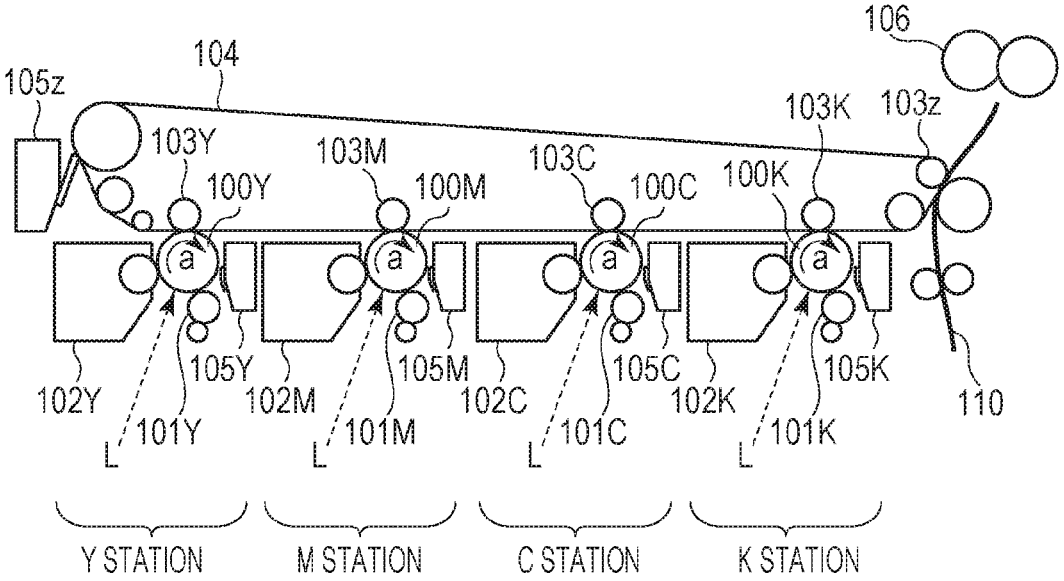
FIG. 1 is a schematic configuration diagram of an image forming apparatus according to a first embodiment.

FIG. 1 is a schematic configuration diagram of an image forming unit of an image forming apparatus according to a first embodiment of the present invention.

As illustrated in FIG. 1, a developing device according to the first embodiment is used in a full-color image forming apparatus of a so-called tandem type. Drum cartridges that form four color toner images of yellow, magenta, cyan, and black are arranged in parallel. After four colors are superposed on an intermediate transfer belt 104, the colors are collectively transferred to a transfer material. Then, a full color image is obtained by pressing and heating with a fixing unit 106. In the following description, components represented simply by numerals, with the symbols of Y, M, C, and K being omitted, are common components of the drum cartridges for yellow, magenta, cyan, and black in FIG. 1.

An image forming action of the image forming apparatus thus configured will be described.

When the image forming action is started, photosensitive drums 100 as image bearing members rotate in the directions of arrows a. Surfaces of the photosensitive drums 100 are uniformly charged with primary chargers 101 as charging devices. Electrostatic latent images are subsequently formed on the surfaces of the photosensitive drums 100 that are exposed to light by a laser exposure device, not illustrated.

The electrostatic latent images thus formed are developed with developing devices 102 by using a two-component developer containing a magnetic carrier and a non-magnetic toner and are visualized. The toner images developed with the developing devices 102 are transferred to the intermediate transfer belt 104 with primary transfer rollers 103 as transfer devices in a multi-layer transfer manner. A toner image after the multi-layer transfer is transferred to a transfer material 110 conveyed to a secondary transfer unit 103*z*. The toner image transferred to the transfer material 110 is subsequently fixed with the fixing unit 106 as a fixing device. After the toner image is transferred, residues of the transferred toner attached to surfaces of the photosensitive drums 100 and the intermediate transfer belt 104 are removed with cleaners 105, and the photosensitive drums 100 and the intermediate transfer belt 104 are used in subsequent image formation.

Developing Device

Figure 2:
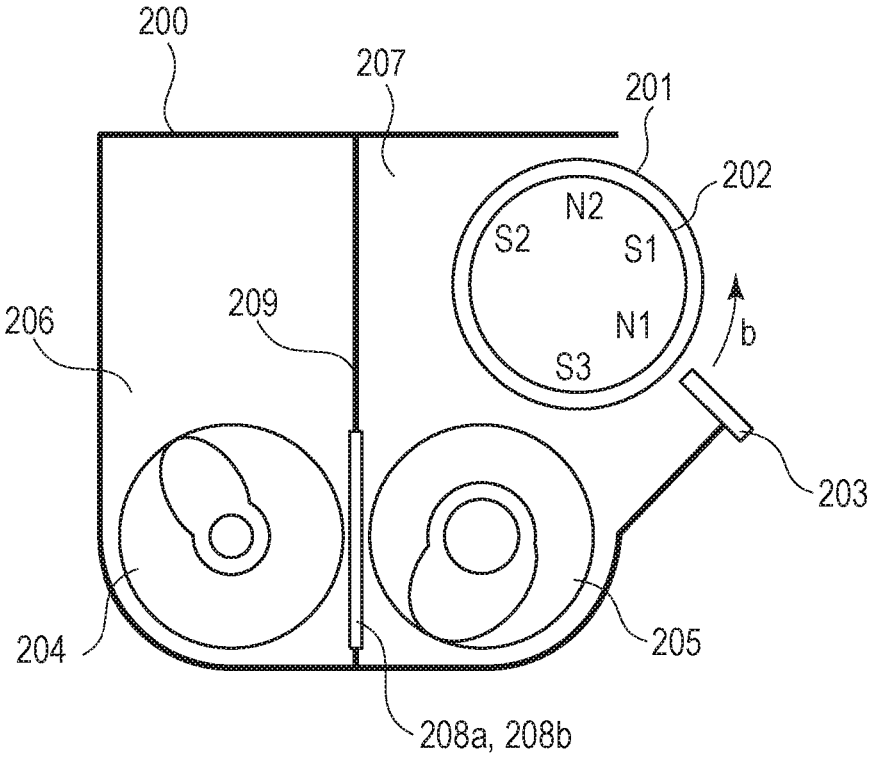
FIG. 2 is a schematic configuration diagram of a developing device according to the first embodiment.
Figure 3:
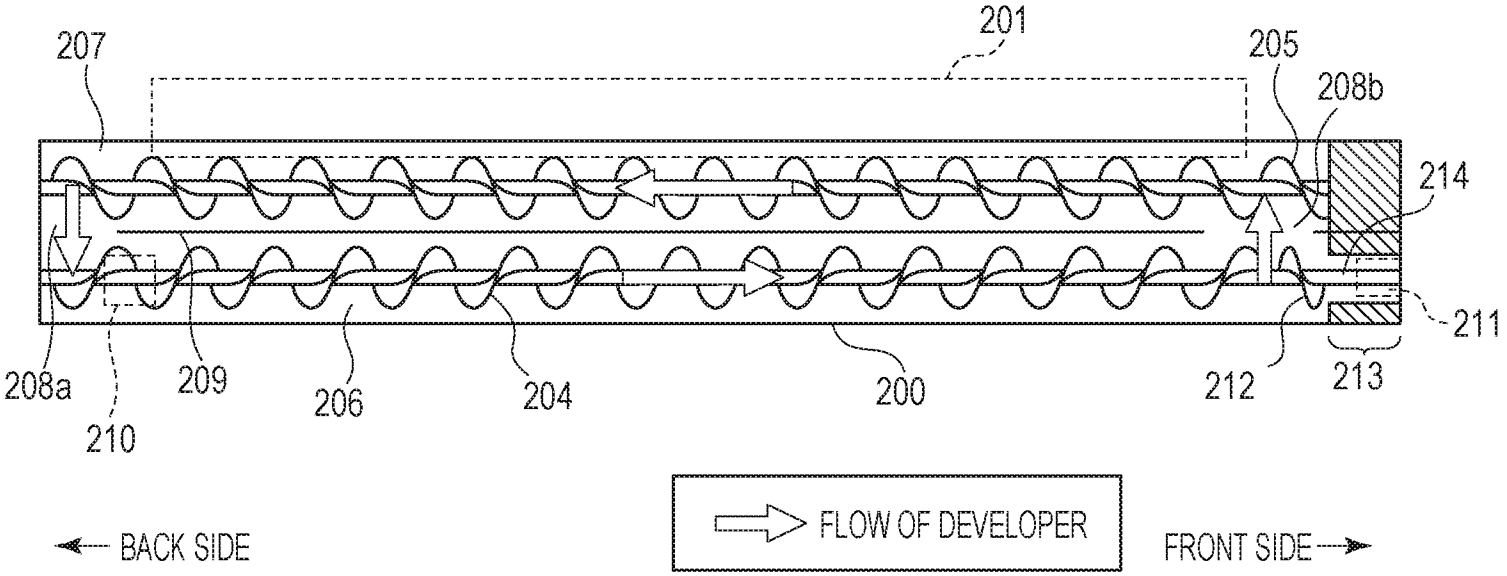
FIG. 3 is a schematic configuration diagram of the developing device according to the first embodiment.

The developing devices 102 will now be described in detail with reference to FIG. 2 and FIG. 3. As illustrated in FIG. 2 and FIG. 3, each developing device 102 includes a developer container 200 containing a two-component developer. The developing device 102 also includes a developing sleeve 201, which is a developer bearing member, made of a non-magnetic material such as SUS or aluminum. The developing sleeve 201 is disposed on the developer container 200 so as to be rotatable in the direction of an arrow b. The developing sleeve 201 bears and conveys the developer to a developing area facing the corresponding photosensitive drum 100 and develops the electrostatic latent image formed on the corresponding photosensitive drum 100. The diameter of the developing sleeve 201 is 20 mm in the first embodiment. A magroll 202 (illustrated in FIG. 2 only), which is a means of generating a magnetic field, is secured to and disposed on the inside of the developing sleeve 201. The surfaces of the developing sleeve 201 are rotated along the outer circumference of the magroll 202 at a speed of 500 rpm. A regulating blade 203 (illustrated in FIG. 2 only), which is a means of developer regulation, is disposed so as to face the developing sleeve 201 at an interval and regulates the amount in which the developer borne by the developing sleeve 201 is coated. In the first embodiment, the interval between the developing sleeve 201 and the regulating blade 203 is 350 μm.

A first conveying screw 204 and a second conveying screw 205, which are developer-agitating and -conveying members, are disposed inside the developing device 102. The developer contained in the developer container 200 is conveyed from the upstream side in the direction of conveyance of the developer to the downstream side (front side direction in the figures) while being agitated by the first conveying screw 204 disposed in a first conveyance passage 206. The developer contained in the developer container 200 is also conveyed from the upstream side in the direction of conveyance of the developer to the downstream side (back side direction in the figures) by the second conveying screw 205 in a second conveyance passage 207. The first conveyance passage 206 and the second conveyance passage 207 are partitioned by a partition wall 209. In this way, a circulation path through which the developer circulates is formed of the first conveyance passage 206 and the second conveyance passage 207 with the partition wall 209 interposed therebetween. Part of the developer circulating in the developer container 200 is supplied from the second conveyance passage 207 to the developing sleeve 201 by using the magnetic force of the magroll 202. The developer supplied to the developing sleeve 201 is borne on a surface of the developing sleeve 201 by using the magnetic force of the magroll 202 and conveyed to the developing area facing the photosensitive drum 100 when the developing sleeve 201 is rotated. The first conveying screw 204 and the second conveying screw 205 are rotated at a speed of 550 rpm. Blades are spirally formed so as to be centered about screw axes in a period, of 20 mm, and the diameter of the outer circumference of each blade is 17 mm. The two-component developer that is attracted by the magnetic force at the developing area facing the photosensitive drum 100 comes into contact with the surface of the photosensitive drum 100. A developing bias applied to the developing sleeve 201 causes only the toner to be transferred from the developing sleeve 201 to the photosensitive drum 100. In this way, a toner image corresponding to the electrostatic latent image is formed on the surface of the photosensitive drum 100. The developing bias is applied such that an alternating current component is superimposed on a predetermined direct current component $V_{dev}$ V. The alternating current component of the developing bias is a square wave having a frequency of 7 kHz and a peak-to-peak voltage of 1.3 kV.

The developer borne by the developing sleeve 201 after developing is returned to the inside of the developer container 200 when the developing sleeve 201 is rotated. The developer is subjected to magnetic repulsion, detached from the surface of the developing sleeve 201, and returned to the second conveyance passage 207.

A supplementary developer is supplied from a supply port 210 to replenish the toner consumed during such a developing process. The supplementary developer is contained in a hopper, not illustrated, connected to the supply port 210. In the first embodiment, the amount of the toner to be supplied is controlled on the basis of a result of detection by a magnetic permeability sensor, not illustrated, disposed inside the developer container 200. Specifically, the average magnetic permeability of the developer is detected with the magnetic permeability sensor, and the weight ratio of the toner to the developer is calculated from the detected value. When the calculated value is less than 8%, the supplementary developer is supplied. The supply is performed in a manner in which a screw disposed inside the hopper is rotated to convey the supplementary developer in the hopper to the supply port 210. The supplementary developer supplied from the supply port 210 is conveyed while being agitated by using the first conveying screw 204 together with the other developer circulating through the developer container 200.

The supplementary developer used at this time contains a small amount of the carrier mixed in the toner, and the weight ratio of the carrier to the supplementary developer is 10%. The toner is consumed during image formation but the carrier is not consumed. Accordingly, the amount of the developer in the developer container 200 continuously increases when the supply of the supplementary developer continues. For this reason, an outlet 211 is formed at the most downstream position in the direction of conveyance by the first conveying screw 204 in the first conveyance passage 206. Details of the mechanism of the passage extending to the outlet 211, which is a feature of the first embodiment, will be described later. A small amount of the developer is discharged from the outlet 211 such that the amount of the developer in the developer container 200 is maintained within a predetermined range. The above supply enables the toner and the carrier to be continuously replaced by a new toner and a new carrier. Accordingly, a long lifetime can be achieved.

Two-Component Developer

The two-component developer composed of the non-magnetic toner and the magnetic carrier that is used in the first embodiment will now be described. The toner contains a resin binder, a colorant, and, as needed, coloration resin particles containing another additive, and coloration particles containing an external additive such as colloidal silica fine powder. The toner is a negatively charged polyester resin and its volume average particle diameter is preferably no less than 5 μm and no more than 8 μm. In an experiment described later, a toner having a volume average particle diameter of 7.0 μm was used.

Preferable examples of the carrier include iron whose surface oxidizes or does not oxidize, nickel, cobalt, manganese, chromium, a metal such as a rare earth element, an alloy thereof, and oxide ferrite. A method of manufacturing the magnetic particles is not particularly limited. The carrier has a volume average particle diameter of 20 to 50 μm, preferably 30 to 40 μm, and a resistivity of $1.0\times10^7$ Ω·cm or more, preferably $1.0\times10^8$ Ω·cm or more. In the experiment described later, the carrier had a volume average particle diameter of 40 μm, a resistivity of $5.0\times10^7$ Ω·cm, and a magnetization of 260 emu/cc.

Configuration of Automatically Replacing Developer

Figure 4:
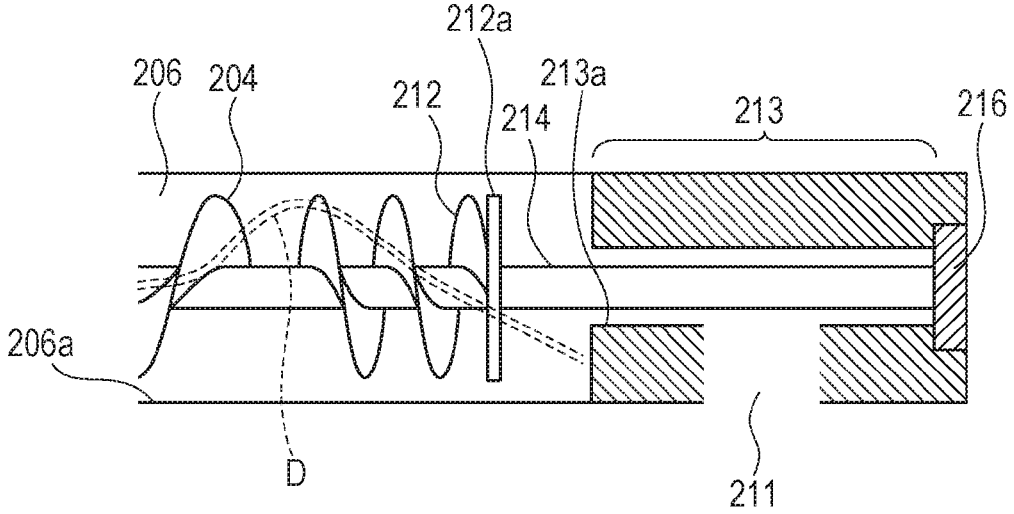
FIG. 4 is an enlarged view of the developing device according to the first embodiment around an outlet.

A configuration of automatically replacing the developer, which is a feature of the first embodiment, will now be described. As illustrated in FIG. 4, a rotating shaft 214 is rotatably disposed in the first conveyance passage 206. The first conveying screw 204 is disposed on the circumference of the rotating shaft 214. The first conveying screw 204 is disposed as a main spiral portion (first blade portion) that includes a first blade portion 204 formed in a spiral shape and that conveys the developer contained in the first conveyance passage 206. The returning screw 212 is disposed on the downstream side of the first conveying screw 204 in the direction of conveyance by the first conveying screw 204. The returning screw 212 is disposed as a spiral sub-portion (second blade portion) including a second blade portion 212 wound around the rotating shaft 214 in the direction opposite co the direction in which the first blade portion 204 is wound. The disk portion 212*a* is disposed on the rotating shaft 214 on the downstream side of the returning screw 212 in the direction of conveyance by the first conveying screw 204. The disk portion 212*a* is disposed so as to protrude in the radial direction of the rotating shaft 214. The disk portion 212*a* prevents the absence of a blade at the upstream end of the returning screw 212 without being affected by the phase of the rotating shaft 214. Accordingly, discharging of the developer can be stable.

The rotating shaft 214 is received by the bearing 216. The bearing 216 in the first embodiment is a resin bearing made of POM (polyoxymethylene). The present invention, however, is not limited thereto.

The discharge passage 213, as a discharge passage (second conveyance passage) through which the two-component developer is continuously discharged to the first conveyance passage 206, is formed on the downstream side in the direction in which the two-component developer is conveyed by the first conveying screw 204. The discharge passage 213 is formed so as to be in communication with the first conveyance passage 206. The discharge passage 213 accommodates the rotating shaft 214 in the inside thereof and is located around the rotating shaft 214 so as to face and be a predetermined clearance away from the rotating shaft 214 of the returning screw 212. The height of a bottom surface 213*a* or one discharge passage 213 is higher than the height of a bottom surface 206*a* of the first conveyance passage 206. An excess of the developer can be discharged to the outside via the clearance between the discharge passage 213 and the rotating shaft 214.

The supplementary developer is a developer in which the carrier is contained in the toner at a predetermined ratio (a weight ratio of about 10%). The ratio is not limited thereto. The toner consumed by the image formation is replenished with a supplier, not illustrated. The supplier contains the supplementary developer containing the carrier at a predetermined ratio as described above and supplies the supplementary developer by using rotation of a supply screw, not illustrated. The supplementary developer is supplied from the upstream side of the developer container 200 in the direction in which the developer is conveyed by the first conveying screw 204.

The supply is controlled such that the concentration of the toner in the developer in the developer container 200 is kept constant. When the supply is thus controlled, the amount of the developer in the developer container 200 increases as the image formation is repeated. The supplementary developer contains 90% of the toner and 10% of the carrier. Accordingly, the toner is consumed by the image formation, but the carrier is not consumed and remains in the developer container. For this reason, the amount of the developer increases as the supply is repeated. When the amount of the developer increases, the surface D of the developer ascends and the developer is conveyed to the outlet 211 beyond the returning screw 212. The developer conveyed to the outlet 211 is discharged from the outlet 211, conveyed to a collection container (not illustrated), collected and stored.

The consumed toner is replenished by the supplementary developer, as described above. The amount of the carrier supplied at the same time becomes excessive, and accordingly, the two-component developer is gradually replaced by a new one automatically such that the amount of the developer in the developer container 200 is kept constant. In this way, a function of automatically discharging the developer is achieved.

A problem occurred in the case where the function of automatically discharging the developer is used will be described with reference to FIG. 5A, FIG. 5B, and FIG. 5C.

Figure 5A:
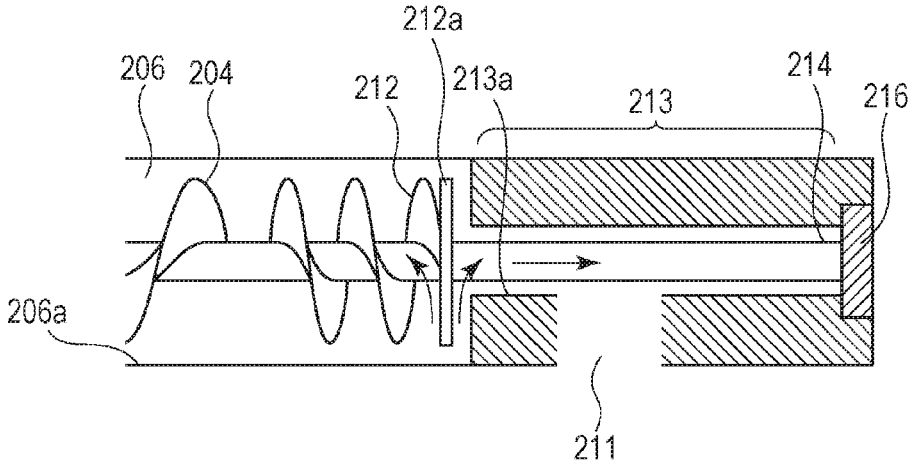
FIG. 5A is a diagram illustrating a problem of a conventional developing device.

As illustrated in FIG. 5A, in the case where the returning screw 212 is near to an entrance of the discharge passage 213, the developer swirled up by the returning screw 212 easily enters the entrance of the discharge passage 213. In fact, the swirled developer was consequently discharged from the outlet 211, and the developer was excessively discharged. The amount of the developer in the developing device 102 was accordingly decreased, and a faint image and an image having a variation in contrast were formed due to a decrease in the amount in which the developing sleeve 201 was coated with the developer. In view of this, as illustrated in FIG. 5B, the distance between the returning screw 212 and the entrance of the discharge passage 213 was increased, and the excessive discharge of the developer was thereby suppressed. The distance k between the upstream end portion of the returning screw 212 and the entrance of the discharge passage 213 is preferably 1.5 mm or more in order to suppress the excessive discharge of the developer and is 2.5 mill in the first embodiment.

Figure 5B:
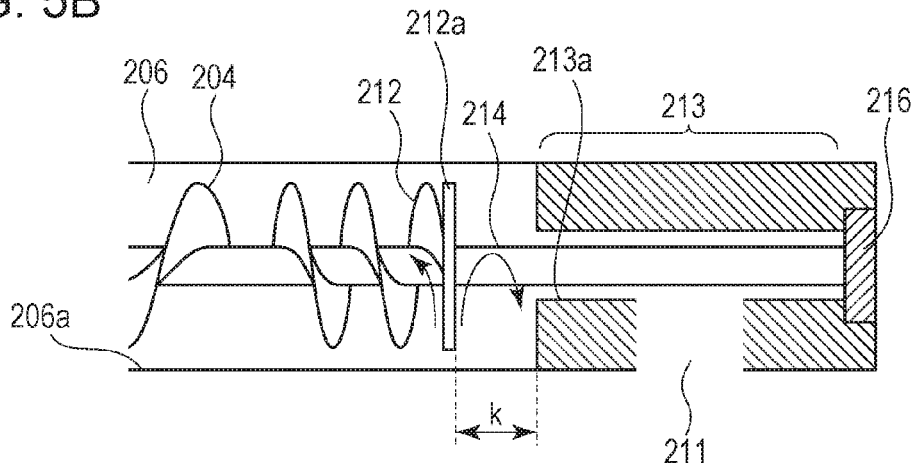
FIG. 5B is a diagram illustrating the problem of the conventional developing device.
Figure 9:
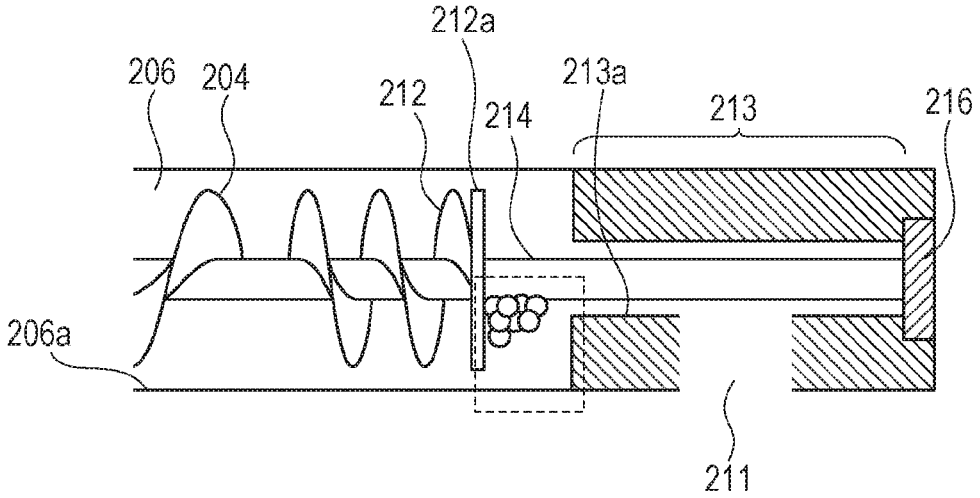
FIG. 9 is a diagram illustrating a problem of a conventional developing device.

As illustrated in FIG. 5B, in the case where the distance k between the returning screw 212 and the entrance of the discharge passage 213 is a predetermined distance or more, there is the immobile area of the developer as illustrated in FIG. 9. The temperature of the end portion of the first conveying screw 204 may be increased by friction against the bearing 216 due to its rotation. Accordingly, the increase in the temperature of the end portion of the first conveying screw 204 may increase the temperature of the developer remaining in the immobile area illustrated within the frame of the dotted line in FIG. 9, and the aggregation toner may be generated. The aggregation toner enters the developer circulation path using developer-agitating and -conveying screws due to vibration of the developing device (for example, when the body of the image forming apparatus is transported or when a unit in the image forming apparatus is replaced by a new one). The aggregation toner may consequently be developed, and accordingly, a toner stain image may be formed.

Figure 5C:
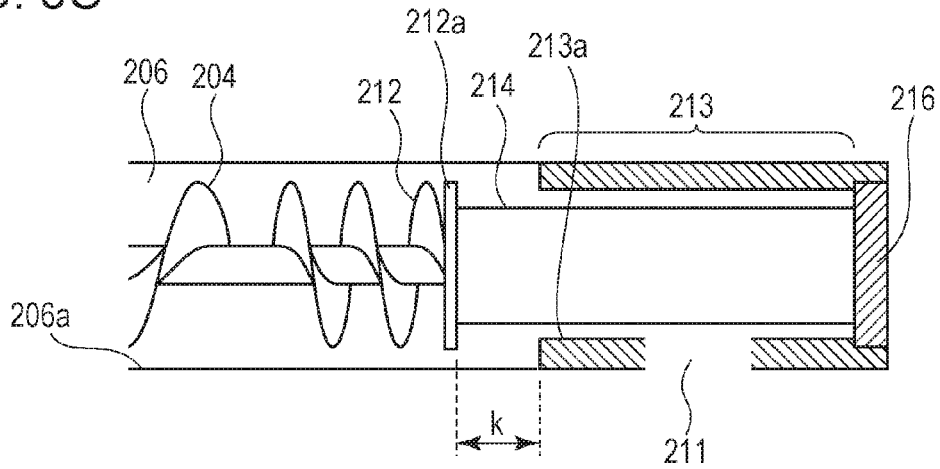
FIG. 5C is a diagram illustrating the problem of the conventional developing device.

In contrast, as illustrated in FIG. 5C, in the case where the entire shaft 214 is thickened, for example, the immobile area of the developer is reduced. However, the height of the bottom surface 213*a* of the discharge passage becomes low, and a step between the bottom surface 213*a* and the bottom surface 206*a* of the first conveyance passage becomes small. Accordingly, the developer in the first conveyance passage easily exits via the outlet 211, and the amount of the developer in the developer container 200 is excessively decreased.

Figure 6A:
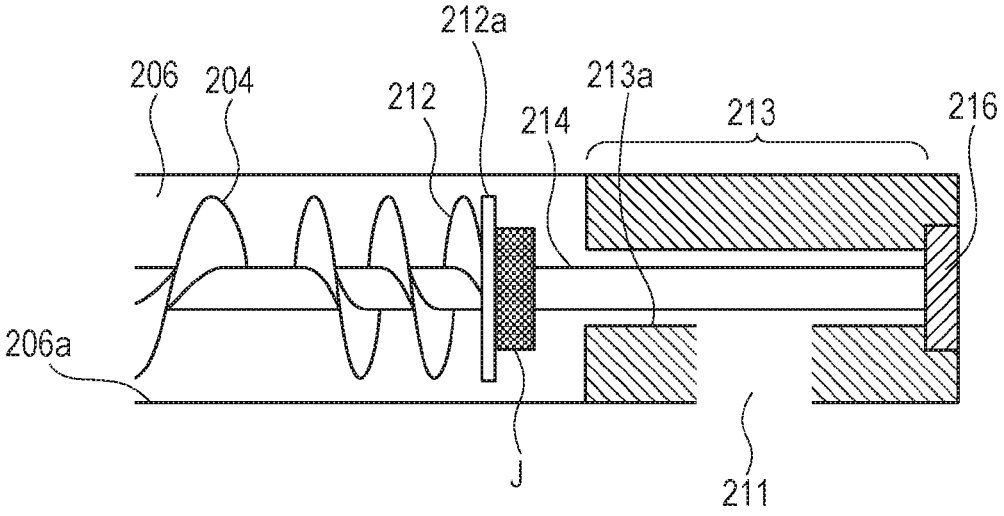
FIG. 6A is a diagram illustrating the developing device according to the first embodiment.

In view of this, in the first embodiment, as illustrated in FIG. 6A, a circular portion J that increases the diameter of the rotating shaft 214 is formed between the disk portion 212*a* and the discharge passage 213 so as to fill a clearance (gap) between the rotating shaft 214 and the container. More specifically, the diameter of the rotating shaft 214 at a position downstream of the disk portion 212*a* in the direction of conveyance by the first conveying screw 204 and upstream of the discharge passage 213 in the direction of conveyance by the first conveying screw 204 is smaller than the outer diameter of the disk portion 212*a*. The diameter of the rotating shaft 214 at the position downstream of the disk portion 212*a* in the direction of conveyance by the first conveying screw 204 and upstream of the discharge passage 213 in the direction of conveyance by the first conveying screw 204 is larger than the diameter of the rotating shaft 214 at a portion facing the discharge passage 213. In this way, the clearance between the rotating shaft 214 and the container is filled between the disk portion 212*a* and the discharge passage 213. The circular portion J is disposed so as to be concentric with the rotating shaft 214 and formed into a cylindrical shape. The diameter of the circular portion J is smaller than the outer diameter of the disk portion 212*a* and is larger than the diameter of the portion of the rotating shaft 214 that faces the discharge passage 213. This causes the immobile area of the developer to be unlikely to occur. In this way, the formation of the toner stain image due to the aggregation toner can be suppressed and stable image formation can be performed over a long period of time.

Figure 6B:
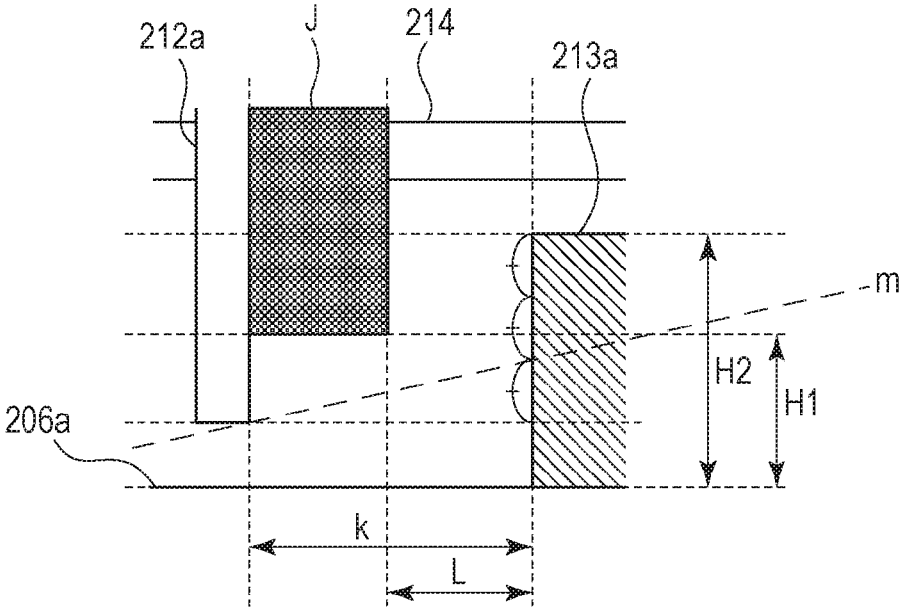
FIG. 6B is a diagram illustrating the developing device according to the first embodiment.

The range in which the immobile area is filled will be described with reference to FIG. 6*k*. A height H1 of the lowest portion of the circular portion J with respect to the bottom surface 206*a* of the first conveyance passage preferably satisfies H1≤H2 where H2 is the height of the highest portion of the bottom surface 213*a* of the discharge passage. The length of the circular portion J, which is calculated by k−L, is preferably 1 mm or more. The reason is that, in the case where an area with which the immobile area is filled is smaller than these, the effect of suppressing the generation of the aggregation toner is reduced. When the distance between the lowest portion of the returning screw 212 and H2 in the vertical direction is divided into three equal distances, a dashed line m in FIG. 6B is a line connecting a position the divided distance away from the height position of the lowest portion to the lowest portion of the returning screw 212 at the most upstream position. The circular portion J preferably does not protrude to an area below the line m. The reason is that, in the case where the circular portion J becomes larger than this, there is a provability that the circular portion J itself spatters the developer, resulting in the excessive discharge of the developer. The symbol L represents a horizontal distance between the highest portion of the bottom surface 213*a* of the discharge passage and the circular portion J and is preferably at least 1 mm or more.

The reason is that, when L is less than 1 mm, there is a probability that the developer is packed and is unlikely to be discharged to the discharge passage 213 or a new aggregate is generated at a narrow area due to friction against the circular portion J.

In the first embodiment, H1=4.5 mm, H2=6.5 mm, and L=1.5 mm hold.

Figure 7A:
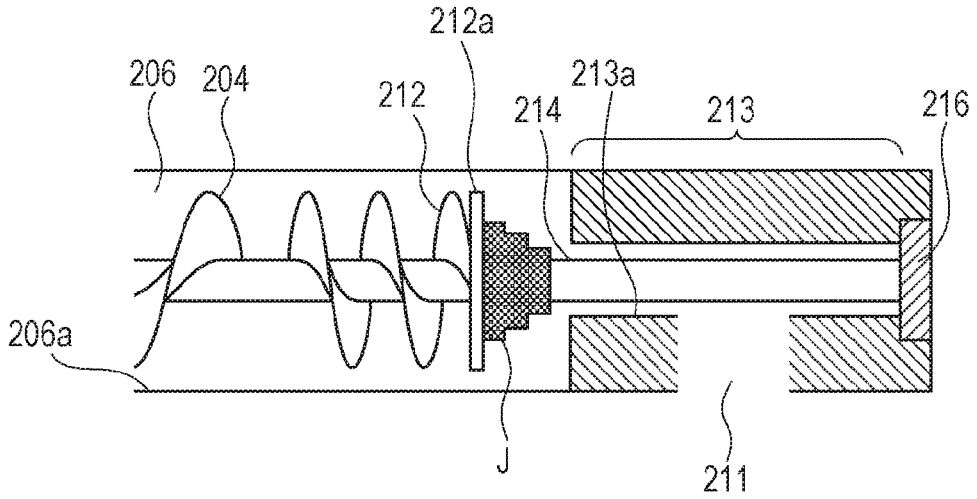
FIG. 7A is a diagram illustrating the developing device according to the first embodiment.
Figure 7B:
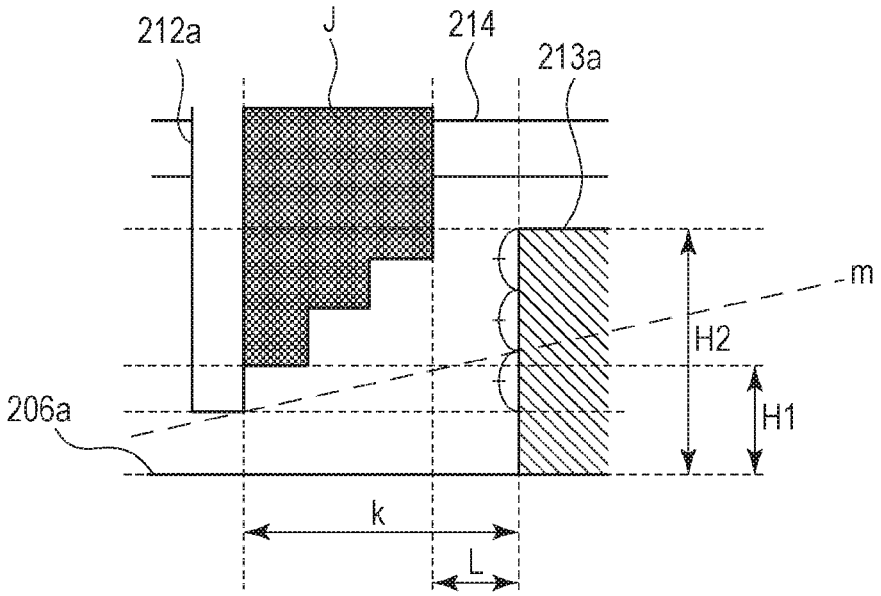
FIG. 7B is a diagram illustrating the developing device according to the first embodiment.

In the first embodiment, as illustrated in, for example, FIG. 7A and FIG. 7B, in the case where a plurality of the circular portions are disposed on the shaft 214, it goes without saying that the same effects are achieved. The height H1 and the distance L in the case where the circular portions are disposed are the same as illustrated in FIG. 7B.

The following description gives a difference in the amount of the aggregation toner generated by continuous image formation between the case where the circular portion was formed on the shaft 214 in the immobile area of the developer that was located on the upstream side of the returning screw as illustrated in FIG. 6A and FIG. 6B and the case where the immobile area was not filled as illustrated in FIG. 5B.

In the case of the configuration illustrated in FIG. 5B, when images were formed at 30° C., the toner stain image due to the aggregation toner was generated when 10000 sheets of paper were fed. In contrast, in the case of the configuration illustrated in FIG. 6A and FIG. 6B, when images were formed at 30° C., no toner stain image due to the aggregation toner was generated after 10000 sheets of paper were fed.

Thus, in the developing device including a mechanism of automatically replacing the developer, the circular portion is formed on the shaft 214 in the immobile area of the developer between the disk portion 212*a* and the discharge passage 213 in order to fill the immobile area. This causes the immobile area of the developer to be unlikely to occur and accordingly suppresses the formation of the toner stain image due to the aggregation toner, enabling stable image formation over a long period of time.

Second Embodiment

A second embodiment will now be described. An image forming process in the second embodiment is substantially the same as in the first embodiment, and accordingly, a duplicative description is omitted.

Figure 8A:
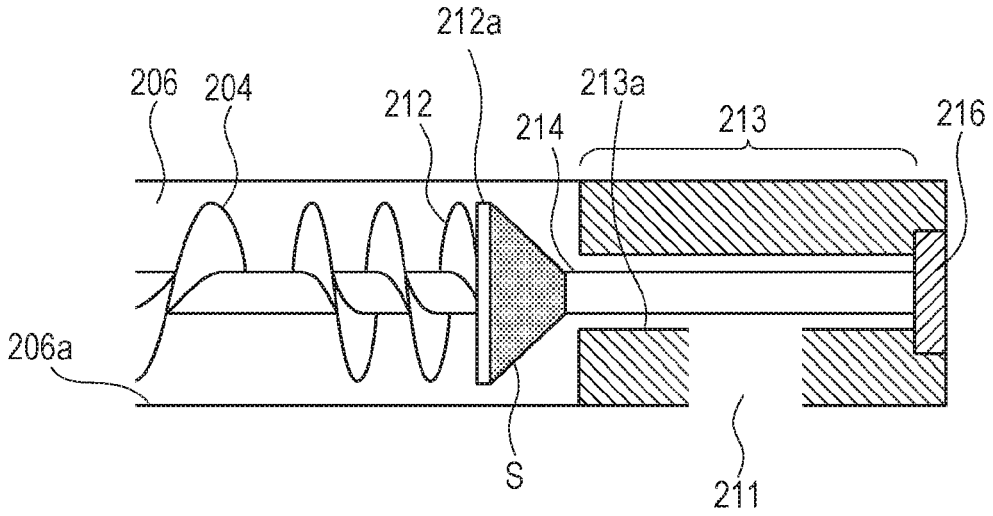
FIG. 8A is a diagram illustrating a developing device according to a second embodiment.
Figure 8B:
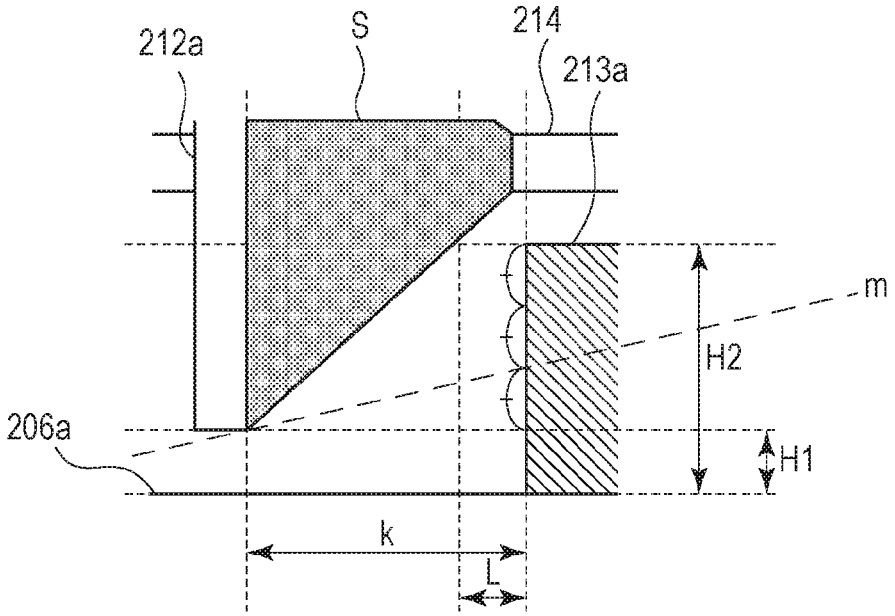
FIG. 8B is a diagram illustrating the developing device according to the second embodiment.

In the second embodiment, as illustrated in FIG. 8A and FIG. 8B, an inclined portion S as the circular portion that increases the diameter of the rotating shaft 214 is disposed between the disk portion 212*a* and the discharge passage 213. The inclined portion S is inclined with respect to the axial direction of the rotating shaft 214. In this way, the clearance (gap) between the rotating shaft 214 and the container is filled between the disk portion 212*a* and the discharge passage 213. This causes the immobile area of the developer to be unlikely to occur and accordingly suppresses the formation of the toner stain image due to the aggregation toner, enabling stable image formation over a long period of time.

The range in which the immobile area is filled will be described with reference to FIG. 8B. A height H1 at which the inclination of the inclined portion begins preferably satisfies H1≤H2. In the case where an area with which the immobile area is filled is smaller than this, the effect of suppressing the generation of the aggregation toner is reduced. The inclined portion S preferably does not protrude to an area below the line m. The reason is that, in the case where the inclined portion S becomes larger than this, there is a provability that the inclined portion S itself spatters the developer, resulting in the excessive discharge of the developer. The value of L is preferably at least 1 mm or more. The reason is that, when L is less than 1 mm, there is a probability that the developer is packed and is unlikely to be discharged to the discharging path 213 or a new aggregate is generated at a narrow area due to friction against the inclined portion S. In the second embodiment, H1=1 mm, H2=6.5 mm, and L=1 mm hold. The inclination of the inclined portion S is constant. The inclination of the inclined portion S, however, may be freely determined within the above conditions. The inclination of the inclined portion S may be formed of a combination of plural inclinations. Although the inclined portion S extends just in front of the discharge passage 213 in the second embodiment, it goes without saying that the effects of the present invention are not affected also in the case where the inclined portion S enters the discharge passage 213 in the horizontal direction, provided that the above conditions are satisfied.

Thus, in the developing device including a mechanism of automatically replacing the developer, the inclined portion is formed on the shaft 214 in the immobile area of the developer between the disk portion 212*a* and the discharge passage 213. In this way, the immobile area is filled. This causes the immobile area of the developer to be unlikely to occur and accordingly suppresses the formation of the toner stain image due to the aggregation toner, enabling stable image formation over a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-170589, filed Aug. 31, 2015, which is hereby incorporated by reference herein in its entirety.

What is claimed is:

1. A developing device comprising:

a developer container that includes a first containing portion and a second containing portion and is capable of containing a developer that includes a toner and a carrier, the second containing portion being separated from the first containing portion by a partition wall, the developer contained in the developer container being able to be circulated between the first containing portion and the second containing portion via a first communication portion that permits the developer to be communicated from the first containing portion to the second containing portion and a second communication portion that permits the developer to be communicated from the second containing portion to the first containing portion;

a developer replenishment portion for supply to the developer;

a developer discharging portion that is provided in the second containing portion for discharging a part of the developer;

a first conveying screw that is provided in the first containing portion for conveying the developer of the first containing portion, and;

a second conveying screw that is provided in the second containing portion and includes:

a rotating shaft;

a first blade portion that is spirally formed on an outer circumference of the rotating shaft and conveys the developer of the second containing portion in a conveying direction that is opposite of a conveying direction of the first conveying screw;

a second blade portion that is spirally formed on the outer circumference of the rotating shaft downstream of the first blade portion with respect to the conveying direction of the first blade portion and upstream of the developer discharging portion with respect to the conveying direction of the first blade portion and conveys the developer of the second containing portion in a conveying direction that is opposite of the conveying direction of the first blade portion;

a disk portion that is provided on and throughout the entire outer circumference of the rotating shaft at, in the conveying direction of the second blade portion, an upstream side end of the second blade portion; and a circular portion that is provided on and throughout the entire outer circumference of the rotating shaft downstream of the disk portion with respect to the conveying direction of the first blade portion and upstream of the developer discharging portion with respect to the conveying direction of the first blade portion in such a way as to protrude in a radial direction, a diameter of the circular portion being smaller than a diameter of the disk portion, wherein the circular portion extends from an end of the disk portion in a rotation axis direction of the rotating shaft.

2. The developing device according to claim 1, wherein the circular portion is formed such that a position of the lowest portion of the circular portion is lower than a position of a highest portion of a bottom surface of a discharge passage that is located downstream of the circular portion with respect to the conveying direction of the first blade portion and upstream of the developer discharging portion with respect to the conveying direction of the first blade portion in the second containing portion.

3. The developing device according to claim 1, wherein the circular portion includes a portion whose diameter at a downstream side in the conveying direction of the first blade portion is smaller than diameter at an upstream side in the conveying direction of the first blade portion.

4. The developing device according to claim 1, wherein the circular portion includes an inclined portion that is inclined with respect to an axial direction of the rotating shaft.

5. A conveying screw that conveys a toner, comprising:

a rotating shaft;

a first blade portion that is spirally formed on an outer circumference of the rotating shaft and conveys the toner;

a second blade portion that is spirally formed on the outer circumference of the rotating shaft downstream of the first blade portion with respect to the conveying direction of the first blade portion and conveys the toner in a conveying direction that is opposite of the conveying direction of the first blade portion;

a disk portion that is provided on and throughout the entire outer circumference of the rotating shaft at, in the conveying direction, an upstream side end of the second blade portion; and a circular portion that is provided on and throughout the entire outer circumference of the rotating shaft downstream of the disk portion with respect to the conveying direction of the first blade portion in such a way as to protrude in a radial direction, a diameter of the circular portion being smaller than a diameter of the disk portion, wherein the circular portion extends from an end of the disk portion in a rotation axis direction of the rotating shaft.

6. The conveying screw according to claim 5, wherein the circular portion includes a portion whose diameter at a downstream side in the conveying direction of the first blade portion is smaller than diameter at an upstream side in the conveying direction of the first blade portion.

7. The conveying screw according to claim 5, wherein the circular portion includes an inclined portion that is inclined with respect to an axial direction of the rotating shaft.

8. The developing device according to claim 3, wherein the diameter of the circular portion decreases step by step from the upstream side toward the downstream side in the conveying direction of the first blade portion.

9. The developing device according to claim 3, wherein the diameter of the circular portion decreases gradually from the upstream side toward the downstream side in the conveying direction of the first blade portion.

10. The conveying screw according to claim 6, wherein the diameter of the circular portion decreases step by step from the upstream side toward the downstream side in the conveying direction of the first blade portion.

11. The conveying screw according to claim 6, wherein the diameter of the circular portion decreases gradually from the upstream side toward the downstream side in the conveying direction of the first blade portion.

* * * * *